US006938554B2

(12) United States Patent
Aaltonen et al.

(10) Patent No.: US 6,938,554 B2
(45) Date of Patent: Sep. 6, 2005

(54) METHOD FOR DETACHING TOWABLE DEVICE FROM SKI LIFT AND DETACHING MEMBER

(76) Inventors: Esa Aaltonen, Fräsintie 5 B 6, Raisio (FI); Esa Bergström, Paraistentie 7 as. 6, Kaarina (FI); Kari Juvonen, Savikatu 4, Turku (FI)

( * ) Notice: Subject to any disclaimer, the term of this patent is extended or adjusted under 35 U.S.C. 154(b) by 18 days.

(21) Appl. No.: 10/472,035

(22) PCT Filed: Mar. 27, 2002

(86) PCT No.: PCT/FI02/00261

§ 371 (c)(1),
(2), (4) Date: Sep. 17, 2003

(87) PCT Pub. No.: WO02/079014

PCT Pub. Date: Oct. 10, 2002

(65) Prior Publication Data

US 2004/0074415 A1 Apr. 22, 2004

(30) Foreign Application Priority Data

Mar. 28, 2001 (FI) ..... 2001637

(51) Int. Cl.[7] ..... B61B 10/00

(52) U.S. Cl. ..... 104/173.1; 104/173.2; 280/477; 198/680

(58) Field of Search ..... 104/173.1, 173.2, 104/175, 176, 178; 198/680; 280/477; 105/149.1

(56) References Cited

U.S. PATENT DOCUMENTS

| | | | | | |
|---|---|---|---|---|---|
| 1,581,944 | A | * | 4/1926 | Nielsen | 104/173.2 |
| 1,971,340 | A | * | 8/1934 | Foulk | 273/361 |
| 3,837,290 | A | | 9/1974 | Dur | |
| 4,681,039 | A | * | 7/1987 | Perrin | 104/193 |
| 4,981,098 | A | * | 1/1991 | Lickle | 114/253 |
| 6,295,936 | B1 | * | 10/2001 | Dahlstrom | 104/173.2 |

FOREIGN PATENT DOCUMENTS

| | | | | |
|---|---|---|---|---|
| CA | 1253445 | | 5/1989 | |
| DE | 27 31 837 | | 2/1979 | |
| DE | 3212683 | | 10/1983 | |
| DE | 3212683 | A * | 10/1983 | B61B/11/00 |
| DE | 3423401 | | 1/1986 | |
| FR | 0 130 897 | | 9/1985 | |
| FR | 2 644 704 | | 9/1990 | |
| FR | 0 456 588 | | 11/1991 | |
| GB | 1 581 944 | | 12/1980 | |
| WO | WO 90/07963 | | 7/1990 | |
| WO | WO 9007963 | A1 * | 7/1990 | A63G/21/04 |

* cited by examiner

*Primary Examiner*—Frantz F. Jules
(74) *Attorney, Agent, or Firm*—Nixon & Vanderhye P.C.

(57) ABSTRACT

The object of the invention is a releasing method and a releasing member for releasing a towed device from a cableway at a desired point without an assisting person or without stopping the lift. According to the method a towing member (2) connected to the towing rope (10) of the towing apparatus (5) of the cableway (4) is released from the clutch member (1) in the towed device by changing the vertical towing angle (R) between the towing member (2) and the clutch member (1) at the release point. In order to change the angle, a releasing member (3), developed for the method and mounted at the release point, is used, whereby the member has a vertical section (V) arranged intersectingly on the towing line at a height, which allows the towed device to pass below it. A safety system (9) can be connected to the releasing member, which system results in the stopping of the lift in the case that the load in the towing direction acting on the horizontal portion (V) exceeds the allowed value. By using this releasing method the dangers which are created if the release would occur too early or too late, are avoided.

19 Claims, 3 Drawing Sheets

METHOD FOR DETACHING TOWABLE DEVICE FROM SKI LIFT AND DETACHING MEMBER

Figure 1:
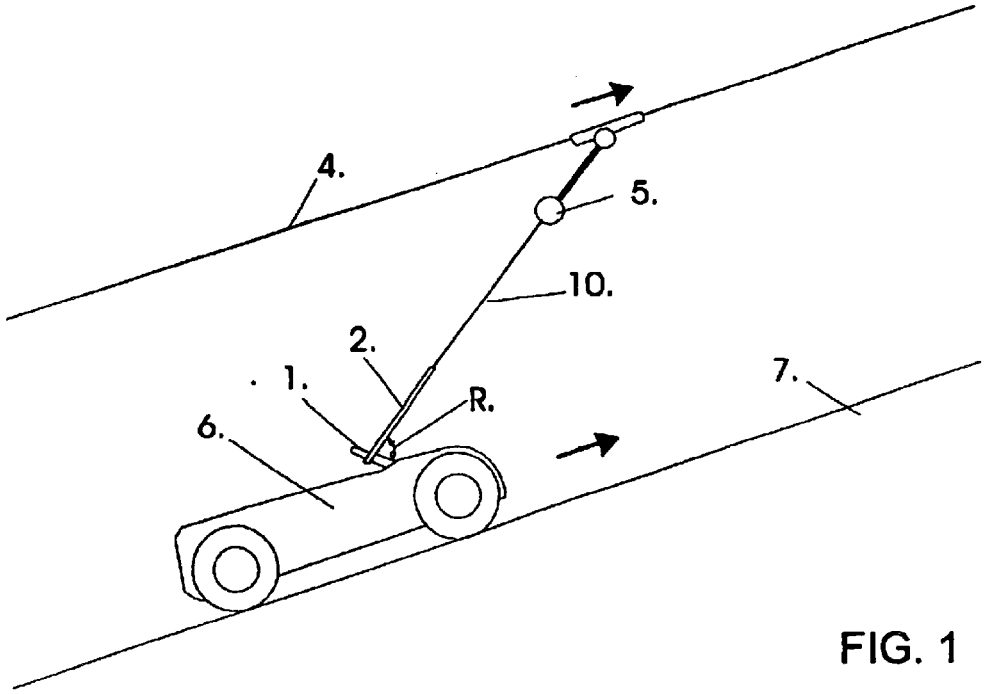

This application is the U.S. national phase of international application PCT/FI02/00261 filed 27 Mar. 2002 which designated the U.S.

The object of the invention is a method for releasing a towed device from a cable-way and a releasing member according to the preambles of the independent claims presented below.

It is well known i.a. at ski slopes to install a cableway, towing equipment including towing ropes and towing members, with which persons with their different equipment both in summer and in winter are towed along the surface of the slope up to the higher part of the slope. The towing member is generally a so called plate or anchor which either directly contacts the towed person or a device, such as a bicycle used by the person. In both cases the person himself will release the towing member in question as he arrives at the desired release point. In so called summer sleds, for which a sled guiding channel is built along the lift's line of ascent, the towing member is clamped to a clutch member in the sled. At the desired release point of the towing member the ascent channel curves away from the lift's line of ascent, whereby the motion direction of the towed device starts to change compared to the vertical plane. Due to a suitable shape of the towing member and the clutch member, the clutch member is automatically released from the sled when there is a sufficiently large difference between the directions of motion.

The greatest disadvantages of the known releasing methods is the reliable and safe release of the towing member from the towed device at the correct point without any assisting person or without stopping the cableway, when the towed device can be controlled by a person, and when it is not forced to follow a certain route or track along the whole towing distance, and particularly not at the release point like the summer sled. It is also known that a release mechanism can be added to the clutch member, which a person in the towed device can use to release the towing member from the clutch member. The main disadvantage of a method like this is that the person may unintentionally either release the towing member too early or leave the release to a too late moment. Both cases can cause danger both to persons and property. The prior art solutions are unnecessarily complicated and thus they are easily broken.

The object of the present invention is to reduce or even to eliminate the above mentioned problems relating to the prior art.

An object of the present invention is particularly to provide a releasing method and a releasing member, which due to their technical solutions enable the release of the towed device from the towing member of the towing apparatus at an exactly defined point without any assisting person or without stopping the cableway. In this method a person in the towed device can not either unintentionally release the towing member at a wrong point, as there is no release mechanism in the towed device.

In order to realise the above mentioned objects among other things, the method for releasing the towed device from the cableway and the releasing member according to the invention are characterised in what is presented in the characterising parts of the enclosed independent claims.

The application alternatives presented in this text and their advantages relate in suitable parts both to the method and to the releasing member according to the invention, even if it is not always specifically mentioned.

The operation of a typical advantageous method according to the invention can be divided into four steps:

1. A suitable clutch member is mounted in the towed device. The towing member attached to the towing rope of the cableway's moving towing apparatus is connected to the clutch member in the towed device.

2. The towing rope of the towing apparatus is wound out into the operating position, whereafter the towed device begins to ascend the slope, towed by the cableway.

3. The towed device arrives, towed by the cableway, at the desired release point, where a releasing member according to the invention is mounted, whereby the releasing member intersects the lift line of the cableway. At this point the towing member and the releasing member will meet. The releasing member changes the vertical towing angle of the towing member compared to the clutch member, so much that the towing member slides out from, or is released in some other way from the clutch member, and thus it releases the towed device from the cableway. At the releasing member there is typically in addition a safety system connected to the lift's drive system. If the releasing member is loaded in the direction of the towing member by a load which exceeds a predetermined load, the releasing member or a part of it will yield in the direction of motion, and at the same time the safety system connected to the releasing member will cause the lift's motion to be stopped. The safety system is easily realised by a clutch, which is connected to the lift's emergency stop circuit.

4. The towing apparatus of the cableway is continuously moving forward without stopping, and the towing rope of the towing apparatus is wound into its basic position. The towed device is guided away from the lift line.

A typical advantageous releasing member according to the invention for releasing the towed device from the cableway without stopping the lift or without having a person to participate in the release comprises a horizontal portion, for instance a bar. Such a horizontal portion is arranged at a desired release point on the cableway's towing line, and in an intersecting direction compared to the towing direction. The horizontal portion is mounted at a height which enables the towed device to pass below it. As the towing member of the towed device contacts the horizontal portion, and the device is still towed toward the horizontal portion, then the vertical towing angle between the towing member and the clutch member will increase until the towing member is released from the clutch member, and thus the towed device is released from the cableway.

Figure 5:
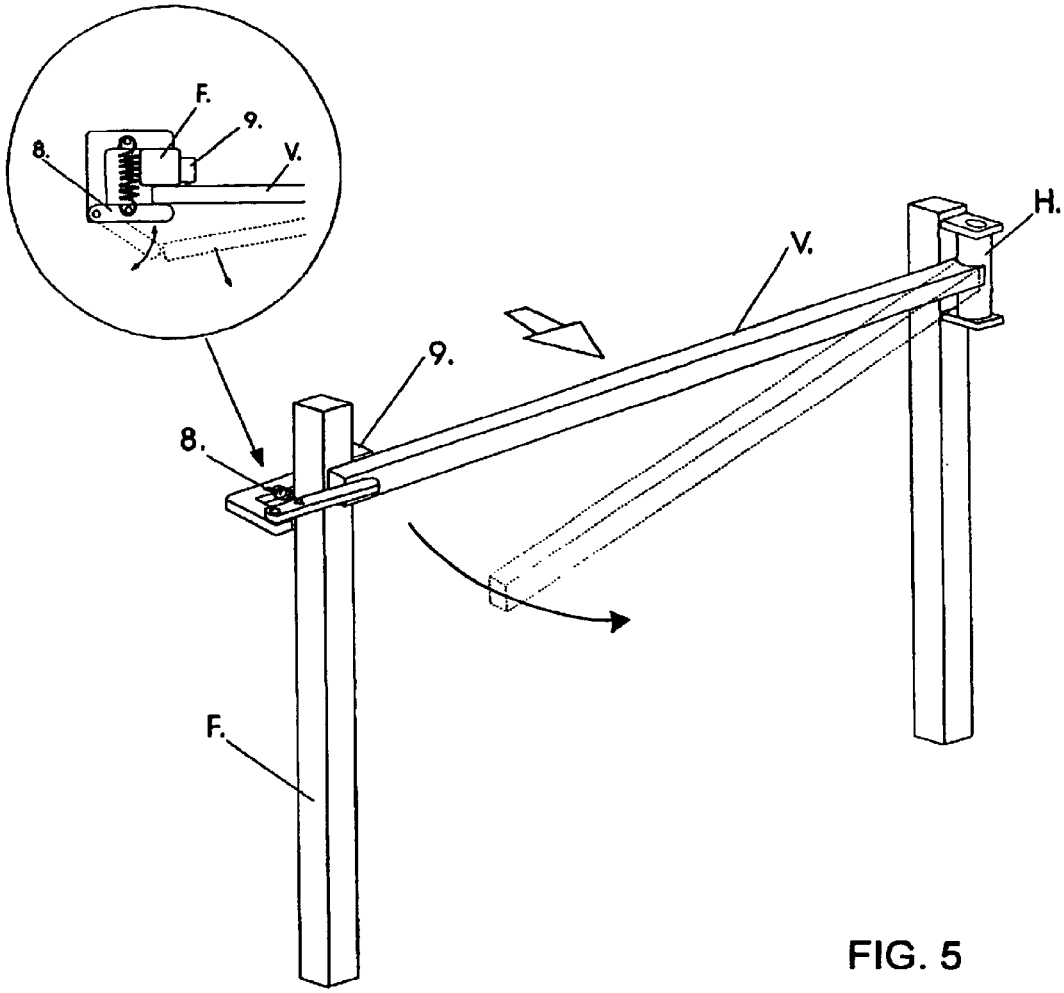
Figure 6:
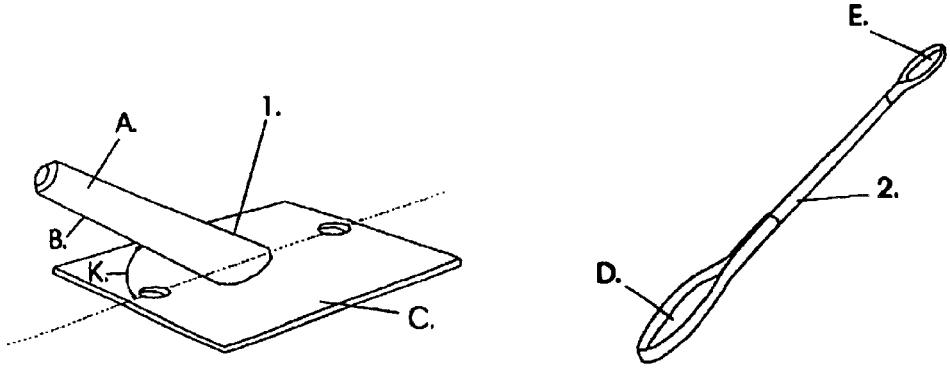

The invention is described in more detail below with reference to the enclosed schematic drawing, where FIGS. 1 to 4 shows schematically the different steps of the method according to the invention;

FIG. 5 shows a releasing member according to the invention and its operation; and FIG. 6 shows a towing member and a clutch member suitable for the method.

FIG. 1 shows how a towed device, such as a vehicle 6 without a motor and moving on wheels, is provided with a suitable clutch member 1. The towing member 2 attached to the towing rope 10 of the towing apparatus 5 in the moving cableway 4 is coupled to the clutch member 1 in the towed device 6, whereby the clutching side B (FIG. 6) of the member's projecting part is arranged at a sufficiently backwards slanting angle K. Due to this angle K the towing member 2 is clutched to the clutch member 1 during the ascent towing. The towing rope 10 of the towing apparatus 5 in the cableway 4 is wound to the operating position, and the towed device 6 moves upwards along the slope surface, towed by the cableway.

Figure 2:
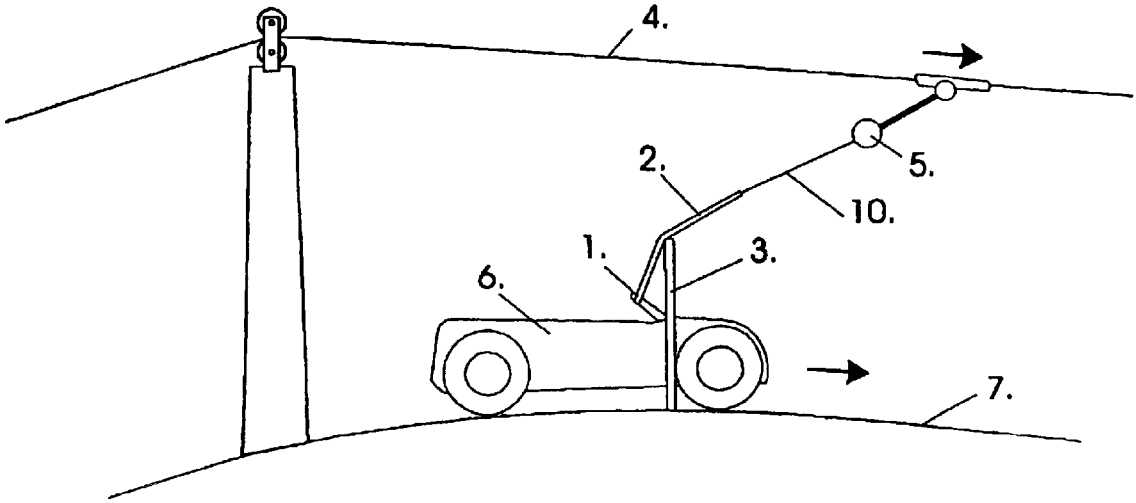

FIG. 2 shows how the towed device 6, towed by the cableway 4, arrives at the desired release point on the lift line 7, and how the towing member 2 and the substantially transversely to the lift line positioned releasing member 3 according to the method meet as the cableway 4 is continuously moving. The best location on the lift line 7 for the releasing member is a point where the rising part of the towing ground ends. Then the backward acting earth's gravitation will not act on the device during the release phase.

Figure 3:
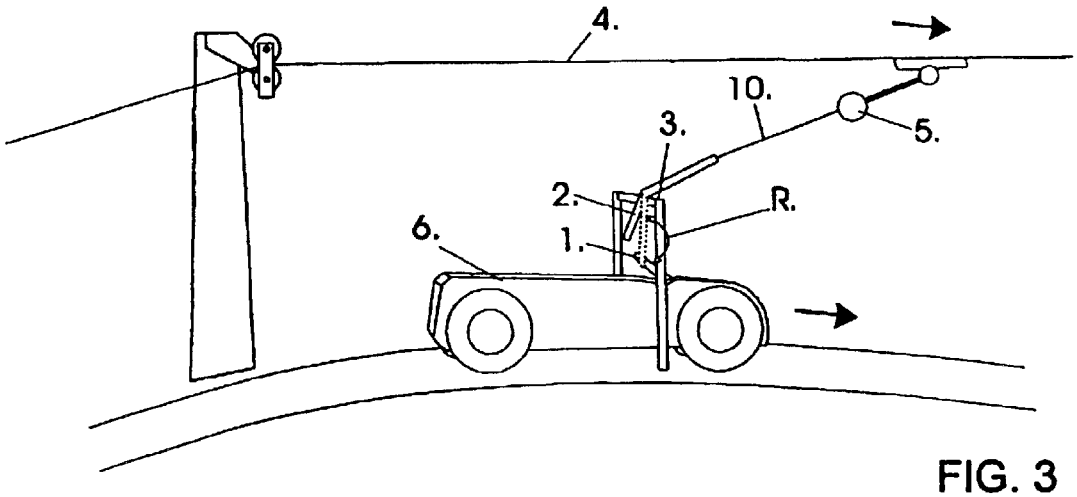

In the situation of FIG. 3 the releasing member 3 changes the vertical pulling angle R of the towing member 2 compared to the clutch member 1, so that the towing member 2 slides off the clutch member 1, and thus releases the towed device 6 from the cableway.

Figure 4:
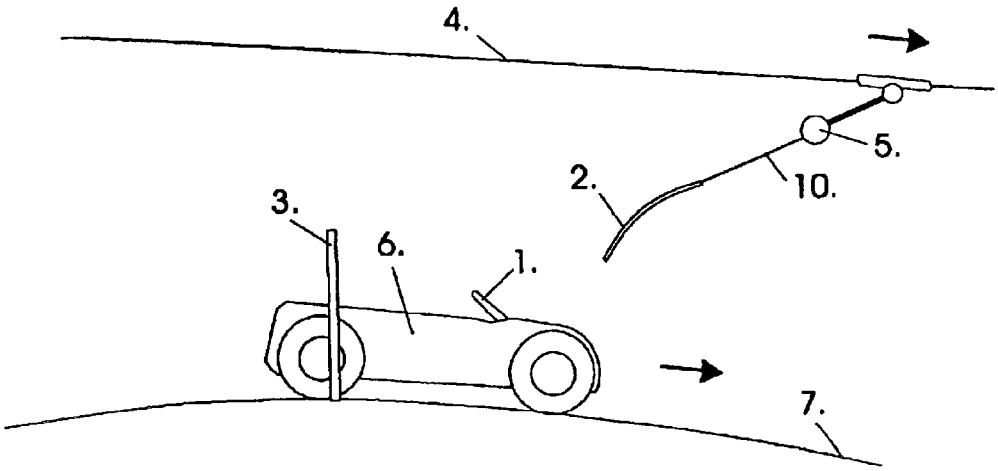

FIG. 4 shows how the towing rope 10 of the towing apparatus 5 is wound into the basic position when the towing member 2 has been released from the clutch member 1, while the towing apparatus 5 is continuously moving. The towed device 6 is guided away from the lift's towing line 7.

FIG. 5 shows one advantageous simplified model of the releasing member according to the invention. The horizontal portion V of the releasing member is supported by two vertical supports H and F. One end of the horizontal portion of the releasing member is fastened in a hinged manner to the vertical support H, and the other end is locked into a locking mechanism 8 in the vertical support F, which mechanism will open at an adjustable load. The locking mechanism may for instance be an adjustable, spring loaded lever. The vertical support F has a safety switch system 9, which is further connected to the electric system of the cableway. If, for some reason, the towing member 2 is not released from the clutch member 1, then the load on the horizontal portion V in the travel direction of the lift exceeds the adjusted limit, and it will release the locked end of the horizontal portion from the locking mechanism 8 in the vertical support F. Then the horizontal portion V turns in the horizontal direction into the towing direction of the cableway, yielding to the load and thus preventing the releasing member 3 from falling and/or from being damaged or the towing rope 10 from breaking. The vertical support F has a safety switch 9, which stops the cableway when the locked end of the horizontal portion V has moved more than the allowed distance.

One advantageous horizontal portion V of the releasing member is made with a considerably large cross section, whereby its circumference may be for instance about one metre. Then there is no danger that a rope or the like released from the towed device would be caught around the horizontal portion and entangled with itself or with the horizontal portion. Advantageously such a horizontal portion is made, at least on that side which receives the towing member, substantially circular with a diameter of about 200, 300 or 400 mm. In practical use, a circular wide boom has proven advantageous, as the towing member will be softly released against it, without any jerks. The wide roundish surface will also prevent any thickness variations, such as bushings, knots or bolts or other projections in the towing member from being caught in the vertical portion.

The locking mechanism 8, which is opened by an overload, and the safety switch 9 can also be mounted in connection with the hinged end of the horizontal portion, whereby a vertical support F is not necessarily needed. The horizontal portion V can also be fastened in an immobile manner to the vertical section H, and these two can be made to turn together, e.g. by hingeing the vertical section H to its mounting base. The vertical supports and the horizontal portion of the releasing member in the figure are made of steel tube. However, the releasing member can be made of different materials and their combinations. A flexible material, e.g. a wire or hose stretched between the vertical supports H and F can also be used as the horizontal portion V.

FIG. 6 illustrates an advantageous clutch member 1 mounted in the towed device 6, whereby the member has a projecting part A made of a steel bar welded to a flange part C made of a steel plate. One or more fastening holes are bored in the flange part C in order to fasten the clutch member to the towed device. The clutching side B of the projecting part A in the clutch member 1 is arranged at a suitable backwards slanting angle K compared to the plane of travel of the towed device. Due to this angle the towing member 2 is kept in the clutch member 1 during the ascent towing. The angle size depends i.a. on the greatest height of the lift's cable from the plane of travel during the towing distance, on the largest angle between the lift cable and the plane of travel during the towing distance, and on the total length of the towing apparatus, the towing rope and the towing member.

The projecting part A and the flange part C of the clutch member 1 can be made from one material for instance by moulding, extrusion, forging, pressing, machining, or in any other manner. The projecting part A can also be fastened directly to the towed device by different methods, whereby no flange part C is needed. There may also be a surface directly shaped in the towed device, which surface then acts as the clutching surface B of the projecting part.

The towing member 2 to be fastened to the towing apparatus 5 of the cableway 4 is made of a flexible material, for instance a load belt, and at its other end there is a fastening loop D intended to be placed on the clutch member 1. The other end of the towing member is fastened to the towing rope 5. If an anchor or plate previously used for other purposes has been fastened to the towing rope 5 with the aid of a cotter bolt extending through the arm, then it is the most feasible to fasten the towing member 2 using the same cotter bolt, so that it extends through a loop E made at the other end of the towing member. The towing member 2 can be made of materials of different thickness and of different flexibility, observing the load and other restrictions placed by the use, e.g. temperature and wear.

One advantageous embodiment each for the releasing method and the releasing member according to the invention as well as for a towing member and a clutch member suitable for the method. The invention is not limited to relate only to the above presented embodiments, but numerous modifications are possible within the inventive idea defined in the claims.

What is claimed is:

1. A releasing method for releasing a towed device from a cableway of a lift at desired release point as the towed device is towed upwardly on a sloping surface in a towing direction along a tow path without stopping the lift or without having a person to participate in the release, said method comprising:

causing a towing member of the lift to release from a clutch member of the towed device at the desired release point by increasing a vertical towing angle between the towing member and the clutch member sufficient for the the towing member to be released from the clutch member at the release point; wherein the vertical towing angle between the towing member and the clutch member is increased by towing the towed device below a horizontal portion of a releasing member positioned on the tow path at the desired release point to thereby cause the towing member, while attached to the clutch member of the towed device, to be brought into contact with the horizontal portion of the releasing member and thereby responsively cause the vertical towing angle to be continually increased as the towed member is towed along the path until the vertical towing angle is sufficiently increased to allow towing member to be released from the clutch member, whereby the towed device is released from the cableway.

2. A releasing method according to claim 1, comprising providing a towing belt as the towing member, the towing belt being made of flexible material having a loop at its free end suitable for connection with the clutch member, and providing a pin-like projection as the clutch member, the projection being mounted on the towed device in a backwards slanting position relative to the towing direction of the towed device along the tow path.

3. A releasing member for releasing a towed device from a cableway of a lift without stopping the lift or without having a person to participate in the release as the towed device is towed in a towing direction along a tow path, said releasing member comprising a horizontal portion arranged to release the towed device from the cableway by increasing a vertical towing angle between a towing member of the cableway and a clutch member of the towed device sufficient to cause release of the towing member from the clutch member, wherein the horizontal portion is mounted at a desired release point which intersects the tow path, and at a height which provides space for the towed device to pass below the horizontal portion at the release point as the towed device is towed along the tow path.

4. A releasing member according to claim 3, further comprising a safety system connected to the releasing member and operative to result in the stopping of the lift in response to the towing member not releasing from the clutch member at the release point.

5. A releasing member according to claim 3, wherein the horizontal portion of the releasing member is hinged at one end, said horizontal portion being operable so that when a certain, adjustable load in the towing direction of the towed device is exceeded, the horizontal portion will turn around the hinge towards the towing direction of the towed device.

6. A releasing member according to claim 4, wherein turning motion of the horizontal portion of the releasing member is arranged to cause the lift to stop by means of the safety system being connected to the releasing member.

7. A releasing member according to according to claim 3, wherein the horizontal portion is arranged substantially transversally to the towing direction.

8. A method for releasing a towed device at a desired release point from a cableway of a lift as the towed device is continually towed in a towing direction along a tow path upwardly on a sloped surface, the method comprising the steps of:

(a) connecting one end of a towing member to the cableway and an opposite end of the towing member to a clutch member affixed to the towed device so as to establish a vertical towing angle between the towing member and the clutch member;

(b) positioning a releasing member at a desired release point and at a height so that the releasing member is positioned above the towed device as it is towed to the release point; and (c) operating the lift so that the cableway continually tows the towed device by the towing member in the towing direction along the tow path to the desired release point to cause the towing member to contact the releasing member at the release point and thereby responsively increase the vertical towing angle between the towing member and clutch member to an extent sufficient to release the towing member from the clutch member.

9. The method of claim 8, further comprising the step of stopping the lift in response to failure of the towing member to release from the clutch member at the desired release point.

10. The method of claim 9, wherein said step of stopping the lift comprising providing the releasing member with a hinged member which pivots in the towing direction in response to failure of the towing member to release form the clutch member thereby responsively stopping the lift.

11. The method of claim 9, wherein the releasing member comprises a horizontal member which extends over the towed device at the desired release point and intersects the towing direction thereof, and wherein said horizontal member is hinged at one end to allow the horizontal member to pivot in the towing direction in response to failure of the towing member to release form the clutch member thereby responsively stopping the lift.

12. The method of claim 8, wherein the releasing member comprises a horizontal member which extends over the towed device at the desired release point and intersects the towing direction thereof.

13. The method of claim 8, wherein the clutch member comprises a pin-like projection extending in a direction opposite to the towing direction, and wherein the towing member has a loop at the opposite end thereof, and wherein step (a) further comprises inserting the pin-like projection of the clutch member into the loop of the towing member.

14. A system for releasing a towed device at a desired release point from a cableway of a lift as the towed device is continually towed in a towing direction along a tow path upwardly on a sloped surface, the system comprising:

a clutch member adapted to being affixed to the towed device;

a towing member having one end adapted to being connected to the cableway of the lift and an opposite end adapted to being connected to the clutch member and establish a vertical towing angle between the towing member and the clutch member, wherein connection of the towing member to the cableway and the clutch member allows the towed device to be towed in the towing direction along the tow path on operation of the lift; and a releasing member adapted to being positioned at the desired release point and at a height so that the releasing member is positioned above the towed device as it is towed to the release point, wherein as the lift operates to continually tow the towed device by the towing member in the towing direction along the tow path to the desired release point, the towing member is caused to contact the releasing member at the release point and thereby responsively increase the vertical towing angle between the towing member and clutch member to an extent sufficient to release connection between the opposite end of the towing member from the clutch member, whereby the towed device is released.

15. The system of claim 14, wherein said releasing member includes a safety system for stopping the lift in response to failure of the opposite end of the towing member to release from the clutch member at the desired release point.

16. The system of claim 15, wherein said safety system includes a hinged member which pivots in the towing direction in response to failure of the towing member to release form the clutch member thereby responsively stopping the lift.

17. The system of claim 15, wherein the safety system includes a horizontal member which extends over the towed device at the desired release point and intersects the towing direction thereof, and wherein said horizontal member is hinged at one end to allow the horizontal member to pivot in the towing direction in response to failure of the towing member to release form the clutch member thereby responsively stopping the lift.

18. The system of claim 14, wherein the releasing member comprises a horizontal member which extends over the towed device at the desired release point and intersects the towing direction thereof.

19. The system of claim 14, wherein the clutch member comprises a pin-like projection extending in a direction opposite to the towing direction, and wherein the towing member has a loop at the opposite end thereof adapted for receiving the pin-like projection of the clutch member.

* * * * *